United States Patent [19]

Obermann

[11] 4,366,352

[45] Dec. 28, 1982

[54] TWO-SPEED CONTINUOUS DRIVE TIMER

[75] Inventor: George Obermann, Niles, Ill.

[73] Assignee: The Singer Company, Schiller Park, Ill.

[21] Appl. No.: 182,720

[22] Filed: Aug. 29, 1980

[51] Int. Cl.[3] ..... H01H 7/08

[52] U.S. Cl. ..... 200/35 R; 74/568 T; 200/38 B

[58] Field of Search ..... 200/35 R, 38 R, 38 B, 200/38 BA, 38 C, 38 CA; 74/568 T

[56] References Cited

U.S. PATENT DOCUMENTS 3,313,895 4/1967 Dotto ..... 200/38 R 3,752,944 8/1973 Cartier et al. ..... 200/38 B

*Primary Examiner*—Gene Z. Rubinson

*Assistant Examiner*—Morris Ginsburg

*Attorney, Agent, or Firm*—Michael, Best & Friedrich

[57] ABSTRACT

The motor drives the timing drum continuously at low speed through a gear train having a one-way clutch. The motor also drives the input of a second one-way clutch having a drive on its output engageable with the spaced teeth on the interrupted gear formed on the hub of the drum. When the low speed drive rotates the drum to a position in which a tooth on the hub can be engaged by the drive gear the drum is rapidly advanced until contact with the tooth is lost. Switches operated by the cams on the drum are sequenced rapidly during rapid advance. When the drum is manually advanced both clutches are overridden.

10 Claims, 5 Drawing Figures

TWO-SPEED CONTINUOUS DRIVE TIMER

FIELD OF THE INVENTION

The invention relates to a two-speed continuous drive program timer having timing cams actuating switches in a desired sequence.

BACKGROUND PRIOR ART

Continuous drive program timers have had limited application due to the difficulty in providing accurate sequential switching of a number of switches in a relatively short period. The usual solution has been to use an impulse drive in combination with subinterval switch(es). Subinterval switching has not been used with continuous drive timers since it is too difficult to register (and maintain registry) of the subinterval switch relative to the program cam(s). Workable designs proved more expensive than an impulse drive. A continuous drive timer capable of accomplishing the desired switching with reliability and modest added cost can have an economic advantage over the impulse drive.

SUMMARY OF THE INVENTION

The object of this invention is to provide a two-speed continuous drive program timer in which the sequencing of a number of switches in a short period of time is accomplished during high speed drive of the program cam. Registry of the rapid drive to the sequence is built in and is not affected by manual advance of the timer. The manual advance capability is very important since it is used in setting the timer. The present design has all the program cams permanently related to one another and to the rapid advance.

DETAILED DESCRIPTION OF DRAWINGS

Figure 2:
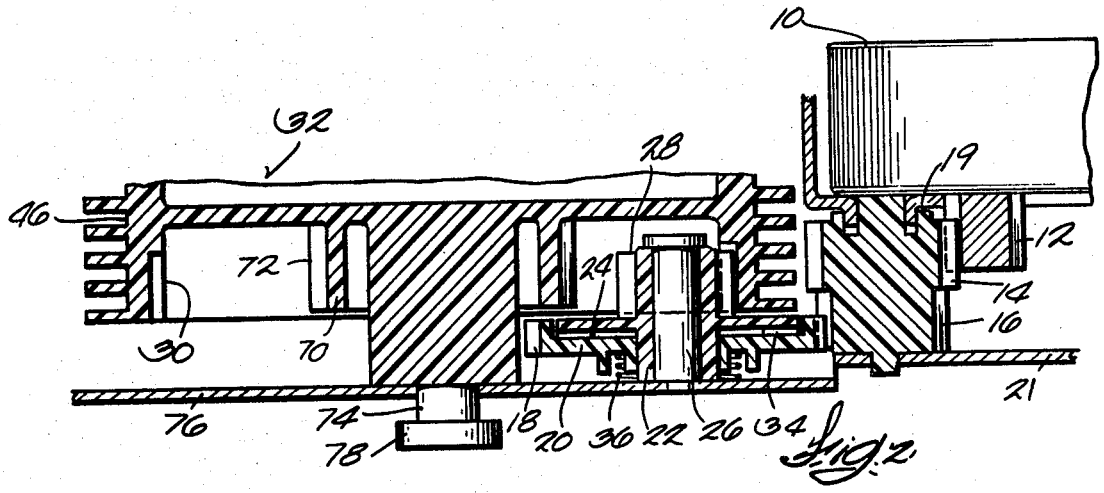
FIG. 2 is a section taken on line 2—2 in FIG. 1 to show the low speed drive.
Figure 3:
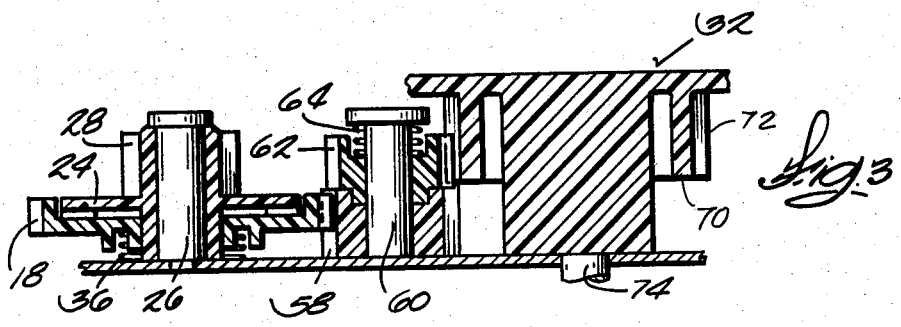
FIG. 3 is a section taken on the angled section line 3—3 in FIG. 1 to show the high speed drive.

An electric motor and reduction gear in case 10 drives pinion 12 projecting from the case. This pinion gear engages idler gear 14 which is molded integrally with pinion 16 and has stub shafts projecting from the ends for journaling the gear/pinion 14, 16 in support plates 19 and 21. Pinion 16 drives gear 18 which is molded integrally with clutch input 20 journaled on sleeve 22 of the clutch output 24. The sleeve is mounted on shaft 26 and is provided with drive pinion 28 meshing with the internal gear 30 on the molded cam drum 32. Clutch input 20 and output 24 have confronting axially projecting ratchet gears 34. The input is biased into engagement with the output by spring 36 to provide a driving connection from the input to the output of the clutch. The gear teeth 34 are shaped so that if the output rotates faster than the input the output will overrun the input by forcing the input downwardly against the bias of spring 36.

The continuously driven gear drive just described constitutes the low speed drive for the cam drum. The drum is provided with multiple cam profiles 38 for actuating switch assemblies such as illustrated. The proximal ends of the blades are mounted in wafers 39 fixed in the timer. The switch and cam arrangement shown is representative and can, of course, be changed. For the present purposes, however, it is adequate to note that the distal end of the lower blade 40 is fixed to an arm projecting from guide 42 having a depending follower portion 44 which rides on the smooth surface 46 between the cams. This serves to position the lower blade and the contact carried by the lower blade. The upper blade 48 is self-biased downwardly so that the tip will rest on pad 50 but may be lifted upwardly therefrom as illustrated in the drawing. The distal end of the middle blade 52 is provided with a follower 54 which rides on and is actuated by the cam 38. In the illustrated position, the middle blade contact has been actuated upwardly into engagement with the contact on the end of the upper blade 48. When the cam rotates a little further in the direction of the arrow, the follower will drop down to a middle level on the cam profile and will separate from the upper blade so all circuits are open. When the cam rotates a little bit further, the follower will drop all the way down into the portion designated 56 and will engage the contact on the lower blade 40.

It will be understood that with various cam profiles and switches actuated by the cam there can be a portion of the program in which it is important to have the switches sequenced rapidly relative to one another but in an accurate sequence nevertheless. At these times, it is advantageous to increase the rotational speed of the timing drum so that tolerances are not extremely critical and yet the desired sequencing can be obtained within a short time frame. The present design provides a high speed drive in a very simple manner.

Figure 1:
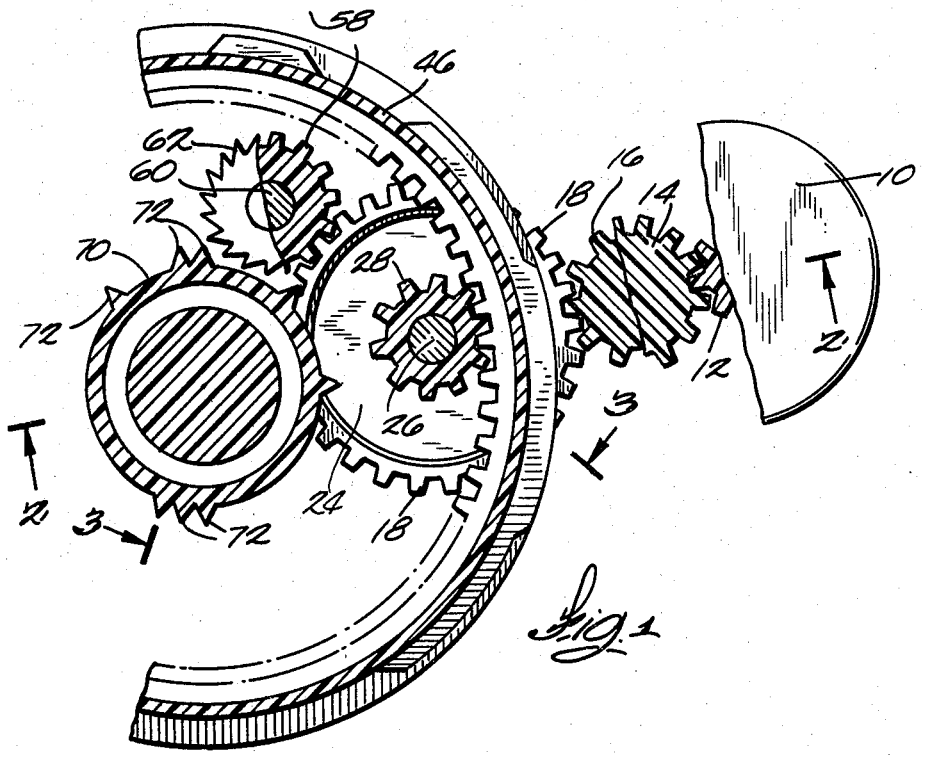
FIG. 1 is a partly schematic plan view showing the general arrangement of the continuous drive.
Figure 4:
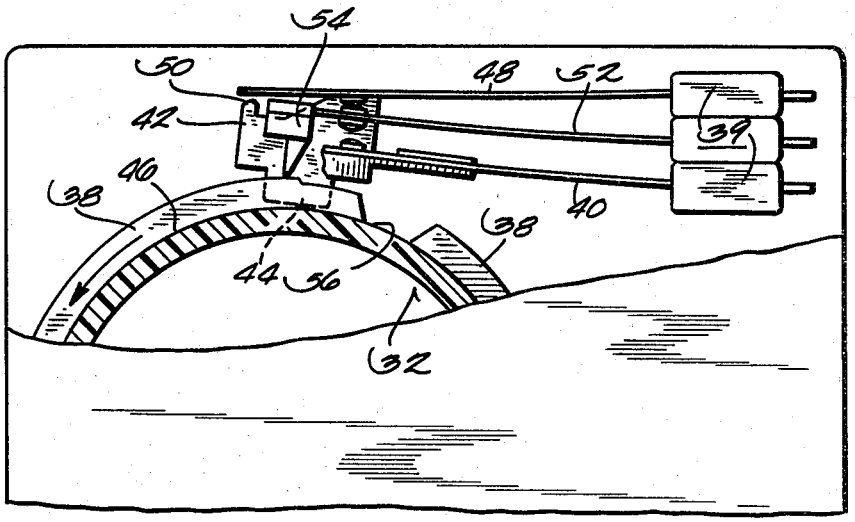
FIG. 4 is a fragmentary view showing part of a cam profile and a switch actuated by the cam.
Figure 5:
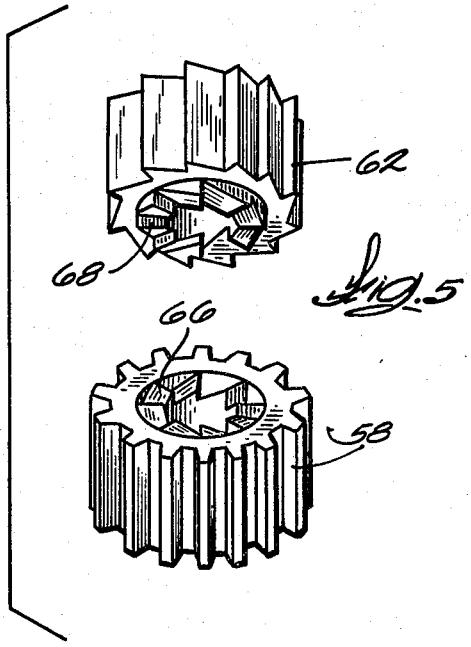
FIG. 5 is an exploded perspective showing details of the one-way clutch used in the high speed drive.

It will be noted that gear 18, which is continuously driven by the motor and is on the input side of the clutch driving to pinion 28 which in turn drives the internal gear of the cam drum, also engages gear 58 journaled on shaft 60. A ratchet gear 62 is also journaled on shaft 60 and is biased downwardly towards gear 58 by spring 64. The confronting faces of gears 58 and 62 are provided with interfitting ratchet-type teeth 66, 68 which constitute a one-way drive clutch which will yield to permit the ratchet gear 62 to overrun gear 58 if the ratchet gear 62 is rotated faster than gear 58. In the position shown in FIG. 1, the ratchet gear 62 does not engage anything since the gear teeth lie close to a smooth portion of the hub 70 of the cam drum. The hub is, in effect, an interrupted tooth gear. At predetermined points around the surface of hub 70, there are gear teeth 72 which, in the course of time, will rotate to a position to be engaged and driven by the sharp teeth of the ratchet gear 62 which rotates continuously at relatively high speed. At this time the ratchet gear will drive the cam drum at a speed substantially faster than the normal rotational speed of the drum. The drive will continue until the ratchet gear 62 has driven the gear tooth 72 on the hub to the point where contact is lost between the two. If there is only one tooth at a location, the high speed drive will be of a relatively short duration. However, two teeth or three teeth can be located side-by-side to increase the angular travel of the drum during which the drum is driven at high speed. Since the gear teeth 72 and cam drum are an integral molded part the precise location of the teeth relative to the cam profiles is built into the design.

It will be noted the drum arbor is shown as provided with a shaft 74 projecting through plate 76 and having a knob 78 for manual actuation. This is simply a schematic representation of the fact that the cam drum can be manually advanced to a given position. Normally there will be provision for axial movement of the knob and shaft so as to actuate a line switch controlling the overall energization of the timer and the appliance. Customary practice indicates that an anti-reverse pawl will be provided to prevent reverse manual rotation of the drum to prevent damage to switches. When the cam drum is manually advanced it rotates faster than either of the outputs of the one-way clutches and both clutches will be overridden. The one-way clutch in the high speed drive will be overridden only when a gear tooth 72 on the hub engages the ratchet gear 62. When the motor is energized, there is no question about proper reorientation or registry of the rapid advance portion since this is molded into the drum and its hub. It will also be appreciated that when the high speed drive becomes operative, the one-way clutch which normally drives the cam drum at low speed will be overridden because the drum is now rotating faster than the output of that one-way clutch.

With this arrangement, it is only necessary to determine at what points in a program it is desired to have high speed drive and then locate one or more gear teeth 72 on the hub at a position which will cause the ratchet gear 62 to complete the high speed drive. The angular travel of the cam drum at high speed is determined by the number of teeth 72 molded on the hub to be engaged in sequence by the ratchet gear 62.

This arrangement provides extremely reliable high speed operation of the cam and the proper registry of the high speed operation is assured since the cams and teeth 72 are molded at the same time. The ability to manually advance the timer is retained and the construction can be manufactured at substantially lower cost than an impulse timer with subinterval switching. A further advantage of the present construction over an impulse timer with subinterval switching is that there is substantially greater flexibility in program selection and sequencing with this construction.

I claim:

1. A program timer having a plurality of timing cams located on a rotating member and controlling the operation of switches in a predetermined program, said rotating member being driven by a motor through a gear train, characterized by, a one-way clutch in the gear train and having an input and an output, the output being drivingly connected to the rotating member and overriding the input when the rotating member is rotated at a speed greater than imparted through the one-way clutch, a drive gear constantly rotated by said motor, said rotating member including an interrupted tooth gear having gear teeth engageable by said drive gear and spaces between the gear teeth so the drive gear can only rotate the interrupted tooth gear when the drive gear engages one of the gear teeth, said rotating member being driven at higher speed when the drive gear drives the interrupted tooth gear.

2. A program timer according to claim 1 including a second one-way clutch located between said motor and said drive gear.

3. A program timer according to claim 2 in which the rotating member is an integral member including said timing cams and said interrupted tooth gear whereby the spaced gear teeth are precisely and permanently located relative to the timing cams.

4. A program timer according to claim 3 in which the rotating member is a cam drum having the timing cams on the drum exterior and the interrupted tooth gear is located on the hub of the drum.

5. A program timer according to claim 4 including means for manually rotating the rotating member, said first one-way clutch being overridden during manual rotation of the rotating member and the second one-way clutch being overridden during manual rotation whenever a gear tooth on said interrupted gear engages said drive gear.

6. A program timer according to claim 2 or 5 in which the input of the first named one-way clutch drives the input of the second one-way clutch.

7. A program timer having a rotatable program member provided with cams actuating switches in sequence, characterized by, a motor, a low speed drive connecting the motor to the program member and including an overrunning clutch having an input and an output, a high speed drive connecting the motor to the program member, means carried by the program member for engaging and disengaging the high speed drive, the output of the low speed drive overriding the input of the low speed drive when the high speed drive is engaged.

8. A timer according to claim 7 including means for manually advancing the program member.

9. A timer according to claim 8 in which both the low and high speed drives include one-way clutch means having an input and an output, the output of each drive overriding the input during manual rotation of the program member.

10. A timer according to claim 9 in which the motor drives the input of both drives continuously.

* * * * *